US008737896B2

(12) United States Patent
Fujita et al.

(10) Patent No.: US 8,737,896 B2
(45) Date of Patent: May 27, 2014

(54) IMAGE FORMING APPARATUS FOR HEATING A RECORDING MATERIAL BEARING A TONER IMAGE

(75) Inventors: Keisuke Fujita, Sagmihara (JP); Masashi Tanaka, Kawasaki (JP); Kohei Okayasu, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/569,678

(22) Filed: Aug. 8, 2012

(65) Prior Publication Data

US 2013/0039683 A1 Feb. 14, 2013

(30) Foreign Application Priority Data

Aug. 12, 2011 (JP) ..... 2011-177143

(51) Int. Cl.
*G03G 15/20* (2006.01)

(52) U.S. Cl.
USPC ..... 399/329

(58) Field of Classification Search
USPC ..... 399/329, 328, 320
See application file for complete search history.

(56) References Cited

U.S. PATENT DOCUMENTS 5,257,078 A * 10/1993 Kuroda ..... 399/329
2006/0233575 A1* 10/2006 Uchida et al. ..... 399/329
2008/0292374 A1* 11/2008 Hiraoka et al. ..... 399/328

FOREIGN PATENT DOCUMENTS

JP 5-208750 A 8/1993

* cited by examiner

*Primary Examiner* — Billy Lactaoen
(74) *Attorney, Agent, or Firm* — Canon USA Inc. IP Division

(57) ABSTRACT

A fixing device configured to heat a recording material bearing a toner image at a nip portion while conveying the recording material includes a tubular film, a nip portion forming member contacting an inner surface of the film, a pressure member forming the nip portion together with the nip portion forming member via the film, and a regulating member configured to regulate a movement of the film by contacting an end surface of the film. The regulating member includes, in a vicinity of the nip portion, a regulating surface inclined such that a distance from an imaginary plane including the end surface is gradually decreased as the regulating surface extends away from the nip portion to a circumferential direction of the film, and that the distance therefrom is gradually increased as the regulating surface extends in a radial direction of the film.

12 Claims, 23 Drawing Sheets

IMAGE FORMING APPARATUS FOR HEATING A RECORDING MATERIAL BEARING A TONER IMAGE

BACKGROUND OF THE INVENTION

1. Field of the Invention

The present invention relates to a fixing device to be used in an electrophotographic image forming apparatus such as a copying machine or a printer.

2. Description of the Related Art

In some cases, a film heating type fixing device, which is advantageous from the viewpoint of quick start or energy saving, is used as a fixing device for an image forming apparatus such as a copying machine or a printer.

The above-mentioned fixing device includes a heat resistant film (hereinafter simply referred to as a film), a heater, and a pressure member forming a nip portion together with the heater via the film. It is common practice to heat a recording material bearing an unfixed toner image at the nip portion while conveying the recording material, thereby fixing the toner image to the recording material.

In this film heating system, there can occur, due to variation in positional accuracy of the film and the pressure member, a phenomenon (hereinafter referred to as a film deviation) in which the film is allowed to deviate in a direction (film generatrix direction) orthogonal to the recording material conveyance direction. As a countermeasure for this film deviation, there is adopted a method in which an edge portion of the film is regulated by a regulating member.

However, when the edge portion of the film is regulated by the regulating member, there may be generated bend, wrinkle, and fissure (hereinafter referred to as a film edge portion damage) due to the film deviation force.

In view of this, Japanese Patent Application Laid-Open No. 5-208750 discusses a fixing device employing a regulating member having a regulating surface such that a distance from an imaginary plane perpendicular to the longitudinal direction of the film is decreased immediately after the nip portion toward the downstream side in the film moving direction, and a regulating surface continuous with the above-mentioned regulating surface and perpendicular to the longitudinal direction of the film. Due to the above regulating member, the film edge portion gradually receives a reaction force of the film deviation force from the regulating surface, thereby suppressing a film edge portion damage.

However, the above-described construction has often proven insufficient in suppressing the film edge portion damage generated by a deviation force applied to the film when a user pulls the recording material out of the nip portion.

This is because the strength of the film deviation force in coping with a jam depends on the force with which the user pulls the recording material out of the nip portion and the angle at which the recording material is pulled out, and, in some cases, there can be generated a deviation force larger than that at the time of fixing.

SUMMARY OF THE INVENTION

The present invention is directed to a film heating type fixing device capable of suppressing a film edge portion damage even when a deviation force larger than that at the time of fixing is generated in the film when a jam is being coped with.

According to an aspect of the present invention, a fixing device is configured to heat a recording material bearing a toner image at a nip portion while conveying the recording material thereby to fix the toner image onto the recording material. The fixing device includes a tubular film, a nip portion forming member contacting an inner surface of the film, a pressure member forming the nip portion together with the nip portion forming member via the film, and a regulating member configured to regulate a movement of the film by contacting an end surface in a generatrix direction of the film when the film moves in the generatrix direction of the film. The regulating member includes, in a vicinity of the nip portion, a regulating surface inclined such that a distance from an imaginary plane including the end surface is gradually decreased as the regulating surface extends away from the nip portion in a circumferential direction of the film, and that the distance therefrom is gradually increased as the regulating surface extends in a radial direction of the film.

According to an exemplary embodiment of the present invention, a film edge portion damage can be suppressed when a deviation force larger than that at the time of fixing is generated in the film while a jam is being coped with.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 is a diagram illustrating the strengths and directions of a pulling-out force and a deviation force applied to the film when a jam is being coped with.

DESCRIPTION OF THE EMBODIMENTS

Various exemplary embodiments, features, and aspects of the invention will be described in detail below with reference to the drawings.

Figure 1:
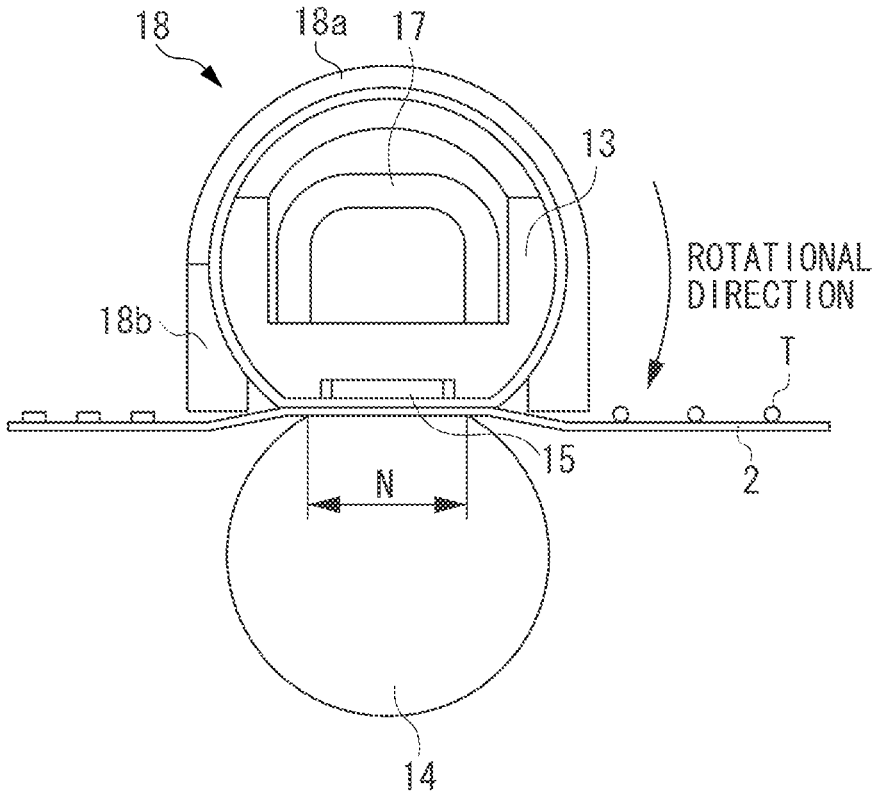
FIG. 1 is a diagram illustrating a cross-section perpendicular to the generatrix of the film of a conventional fixing device.
Figure 2:
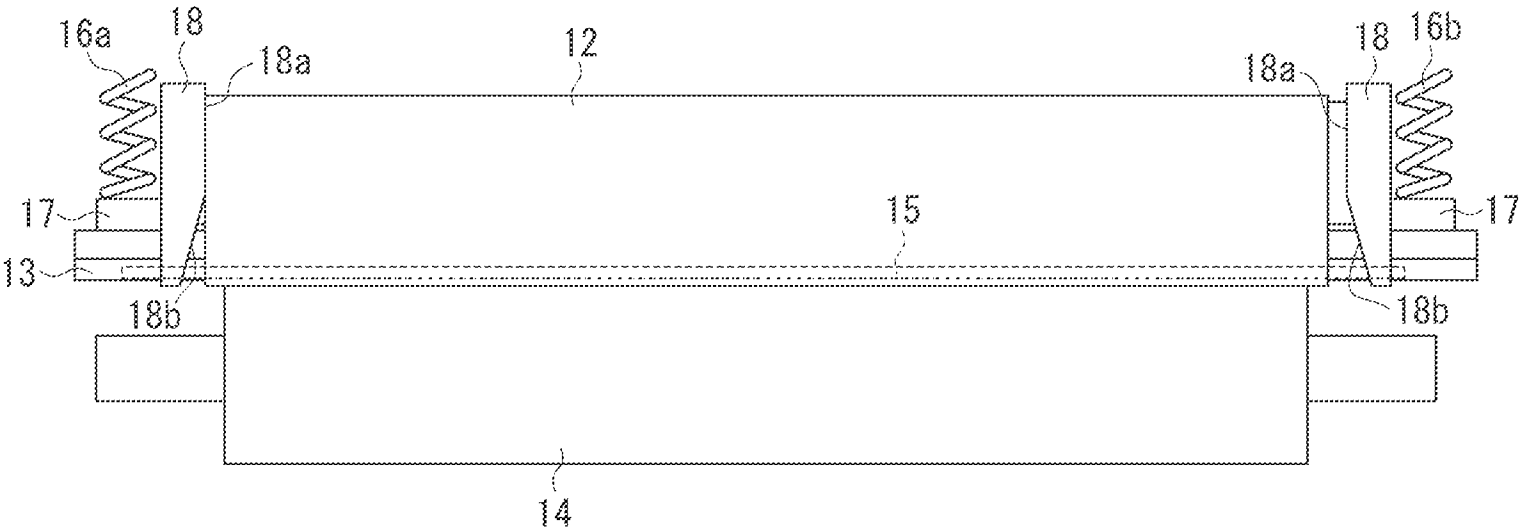
FIG. 2 schematically illustrates how the conventional fixing device extends in a direction orthogonal to the recording material conveyance direction.

Before describing the fixing device according to the first exemplary embodiment of the present invention, the construction of and a problem in a conventional fixing device will be described with reference to FIGS. 1 and 2. FIG. 1 is a diagram illustrating a cross-section perpendicular to the generatrix of the film of the conventional fixing device, and FIG. 2 is a schematic diagram illustrating the conventional fixing device as seen in a direction orthogonal to the recording material conveyance direction.

A tubular film 12 is a heat resistant single-layer film or a composite-layer film having undergone a desired surface treatment or laminate treatment. For example, the material of the single-layer film includes a film of polyester (PET) or polyimide (PI) having undergone heat resistance treatment and having a thickness of approximately 50 μm. The material of the composite-layer film includes a film formed by further forming on the above-mentioned film surface a releasing layer of tetrafluoroethylene perfluoroalkyl vinylether copolymer (PFA) or polytetrafluoroethylene (PTFE).

One surface of a flat-plate heater 15 as the nip portion forming member is retained by a heater holder 13, and another surface thereof, opposite the surface retained by the heater holder 13, contacts the inner circumferential surface of a film 12 to heat the film 12. On the surface of the heater 15 contacting the film 12, there is provided a linear or strip-like heat generation resistor formed of silver palladium or the like by screen printing, etc.

A pressure roller 14 serving as the pressure member forms a nip portion N together with the heater 15 via the film 12. The pressure roller 14 is rotated by a drive force from a drive source (not illustrated), and rotates the film 12 by a frictional force at the nip portion N. As illustrated in FIG. 2, at the nip portion N, the heater 15 is pressed against the pressure roller 14 with a predetermined contact pressure via the film 12 by pressure springs 16*a* and 16*b* via a reinforcing plate 17 and the heater holder 13. At the nip portion N, pressure and heat are applied while conveying the recording material bearing a toner image to thereby fix the toner image to the recording material.

Conventional regulating members 18 serve to regulate a movement of the film 12 at the time of fixing when the film 12 receives a force (hereinafter referred to as a deviation force) in a direction orthogonal to the recording material conveyance direction.

Figure 3A:
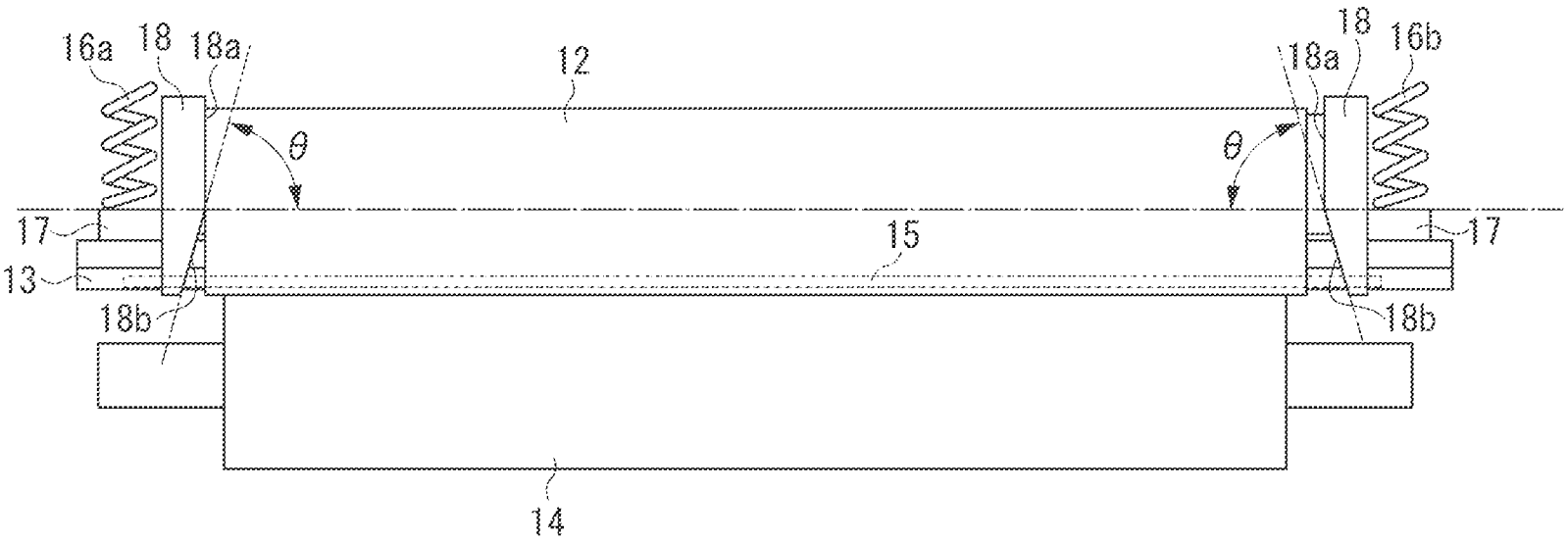
FIG. 3A is a diagram illustrating an angle θ made by a regulating surface of a conventional regulating member and the generatrix of the film.
Figure 3B:
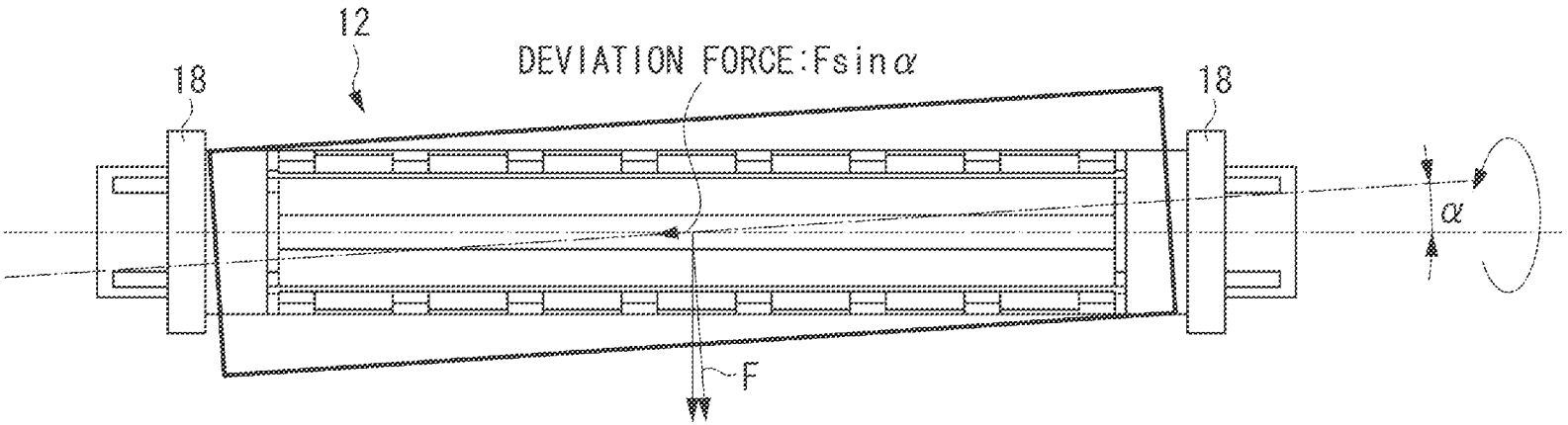
FIG. 3B is a diagram illustrating the direction of a deviation force applied to the film at the time of fixing.
Figure 3C:
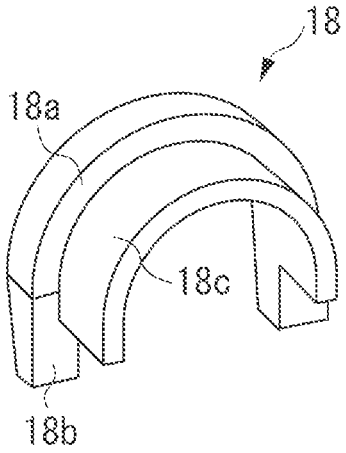
FIG. 3C is a perspective view illustrating the conventional regulating member.

Next, the construction of the regulating member 18 will be described in detail with reference to FIGS. 3A, 3B, and 3C. FIG. 3A illustrates how the conventional fixing device extends in the direction orthogonal to the recording material conveyance direction. Each regulating member 18 includes a regulating surface 18*b* making an angle θ smaller than 90 degrees with the generatrix of the film 12 at rest. The regulating surface 18*b* is a regulating surface such that a distance from an imaginary plane including the end surface of the film 12 is gradually decreased, so that the end surface of the rotating film 12 may be gradually regulated in the rotational direction of the film at the time of fixing, immediately after the outlet of the nip portion. Further, each regulating member 18 includes a regulating surface 18*a* continuous with the regulating surface 18*b* and parallel to the end surface of the film.

Here, the deviation force of the film 12 will be described. FIG. 3B illustrates the condition of the film 12 when the deviation force has been generated in the film 12. The deviation force in the film 12 is generated due to a difference in conveyance force for the film 12 in the direction orthogonal to the recording material conveyance direction, which is caused by variation in the component accuracy or positional accuracy of the components such as the film 12, the heater 15, and the pressure roller 14. FIG. 3B illustrates the condition of the film 12 at this time. When the generatrix of the film 12 is inclined at an angle α with respect to the regulating member 18, due to the above-mentioned difference in conveyance force for the film 12, the film 12 receives a frictional force F in the recording material conveyance direction by the pressure roller 14, so that the deviation force applied to the film 12 can be represented as: $F\sin\alpha$. The larger the frictional force F serving as the conveyance force for the film 12, the larger the deviation force applied to the film 12. When the end surface of the rotating film 12, from a position in the vicinity of the outlet of the nip portion to the regulating surface immediately after the outlet of the nip portion in the film rotational direction, is abruptly regulated in the direction orthogonal to the recording material conveyance direction, the end surface of the film is subject to damage.

To solve this problem, each regulating member 18 is provided with the regulating surface 18*b* such that a distance from the end surface of the film 12 is gradually decreased, so that the end surface of the film 12 rotating in the rotational direction at the time of fixing for the film 12 may be gradually regulated immediately after the outlet of the nip portion. Thus, immediately after the outlet of the nip portion for the film 12, the end surface of the film 12 gradually receives a reaction force against the deviation force from the regulating surface 18*b*, so that the above-mentioned problem is solved.

Next, there will be provided a description about the case where a jam occurs, when the apparatus comes to a stop while nipping the recording material 2 at the nip portion, and the user pulls out the recording material 2 from the downstream side (the outlet side for the film 12 in the film rotational direction) in the recording material conveyance direction to cope with the jam. In this case, the rotational direction of the film 12 is the same as that at the time of fixing. When the recording material is pulled out in a direction parallel to the recording material conveyance direction, no deviation force is generated in the film 12. However, when the recording material 2 is pulled out in a direction at an angle with respect to the recording material conveyance direction, there can be generated in the film 12 a deviation force larger than that at the time of fixing.

In particular, when the user copes with the jam (i.e., pulls out the recording material 2 in a direction at an angle with respect to the recording material conveyance direction) without releasing the pressure at the nip portion, the frictional force between the recording material and the film 12 increases, so that the deviation force of the film increases.

Figure 4:
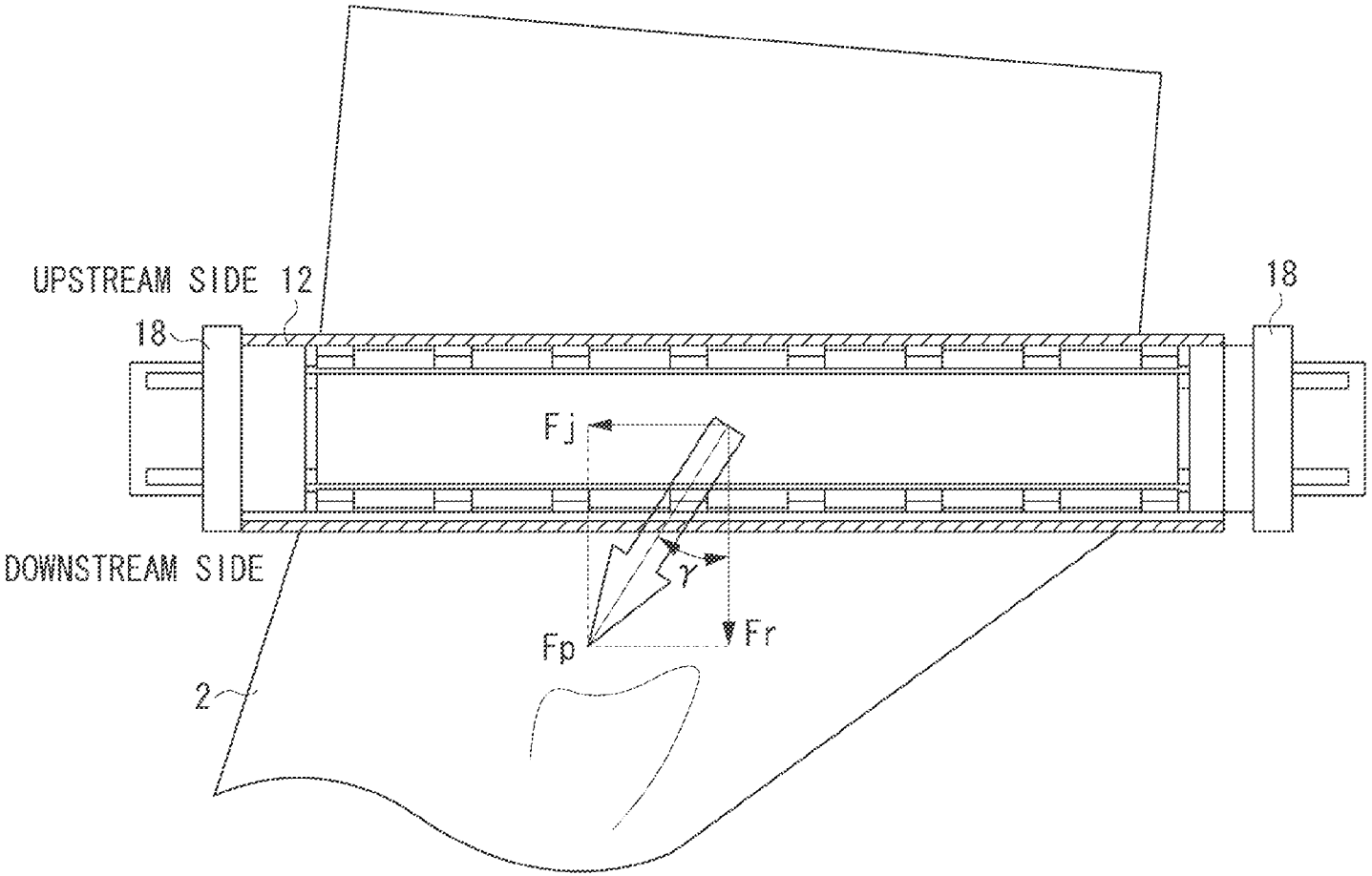

FIG. 4 is a schematic diagram illustrating a case where the recording material 2 is pulled out from the downstream side of the nip portion in the recording material conveyance direction in a direction at an angle γ with respect to the recording material conveyance direction. When the recording material 2 is pulled out with a pulling-out force Fp (the frictional force the film 12 receives from the recording material), the deviation force is Fj, which is a component in the direction orthogonal to the recording material conveyance direction of the pulling-out force Fp. The deviation force Fj in coping with a jam varies according to the pulling-out force Fp and the angle γ, so that the deviation force at this time can be larger than that at the time of fixing depending upon the values thereof.

The larger the deviation force Fj of the film 12, the stronger the force with which the end surface of the film 12 contacts the regulating surfaces 18*a* and 18*b*. Thus, in some cases, the deviation force Fj exceeds the bending stiffness of the film 12, resulting in the edge portion of the film 12 being bent. The edge portion of the film 12 is bent toward the inner circumferential side or the outer circumferential side of the film 12. Alternatively, there may simultaneously exist, in the circumference of the edge portion of the film 12, a portion bent toward the inner circumferential side and a portion bent toward the outer circumferential side.

Figure 5A:
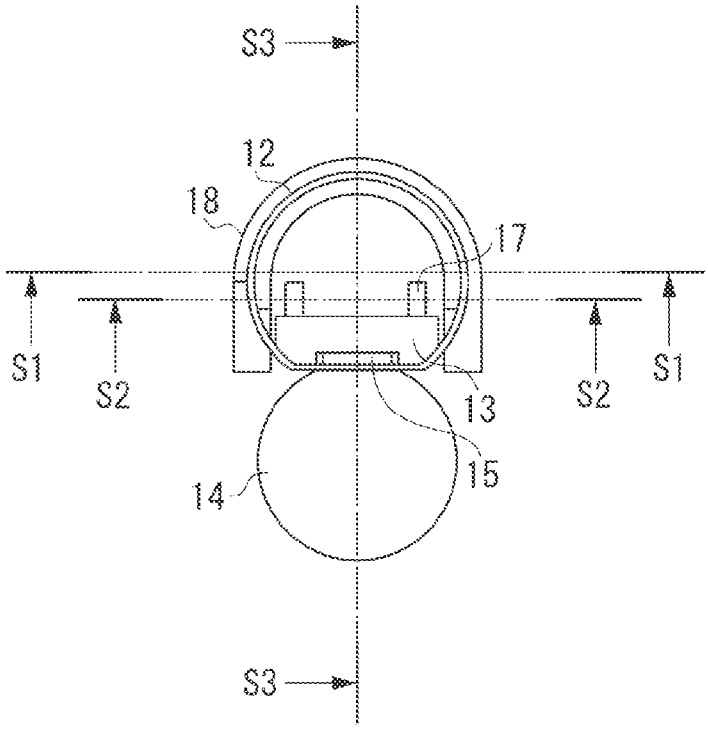
FIG. 5A is a diagram illustrating a cross-section perpendicular to the generatrix of the film of the conventional fixing device.
Figure 5B:
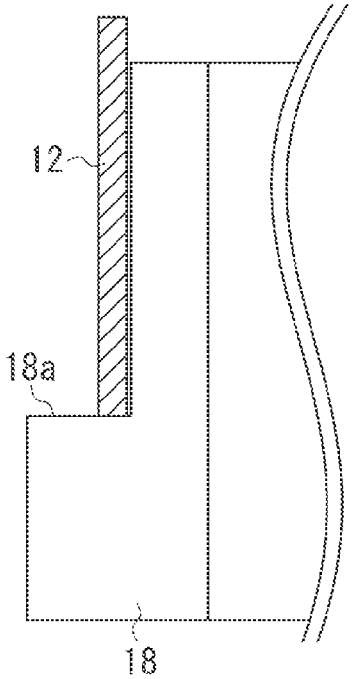
FIGS. 5B, 5C, 5D, 5E, 5F, and 5G are diagrams illustrating how the film edge portion is bent toward the film inner circumferential surface side as a result of the film edge portion contacting the regulating member in the conventional fixing device.
Figure 5C:
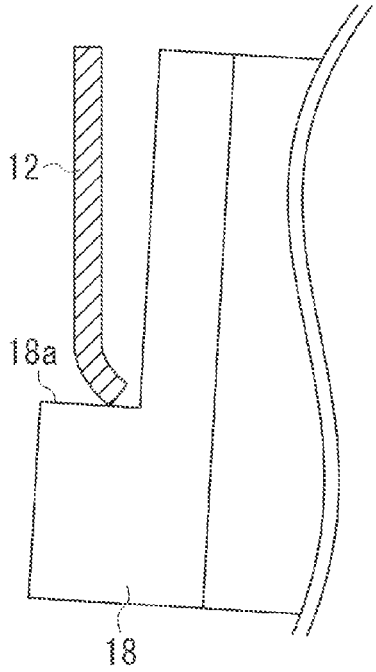
Figure 5D:
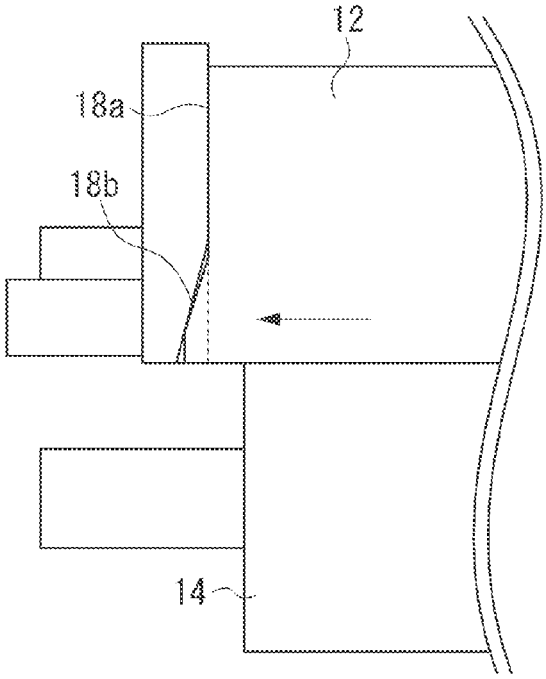
Figure 5E:
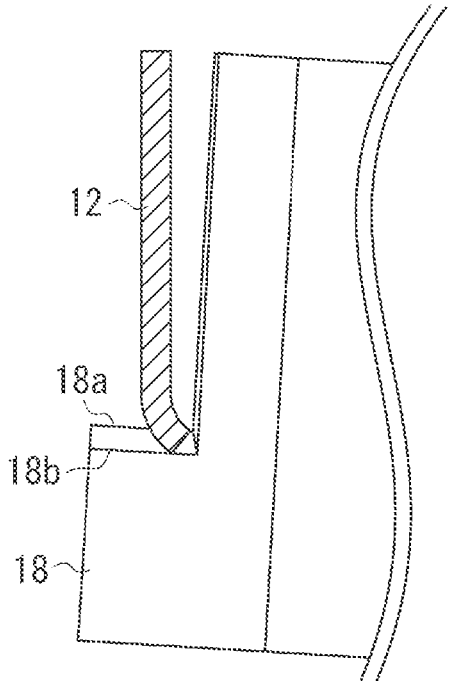
Figure 5F:
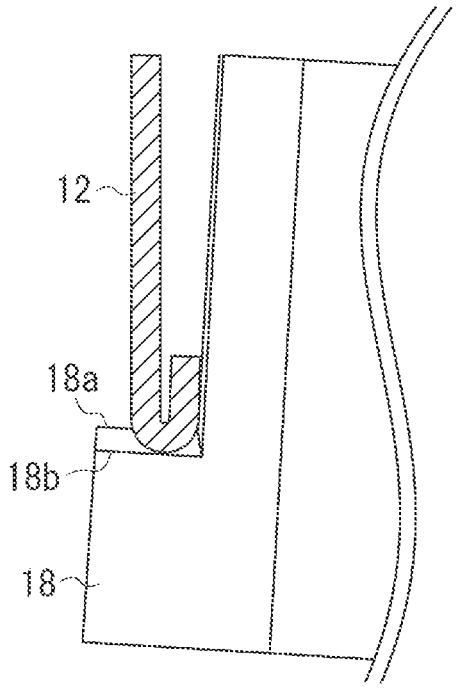
Figure 5G:
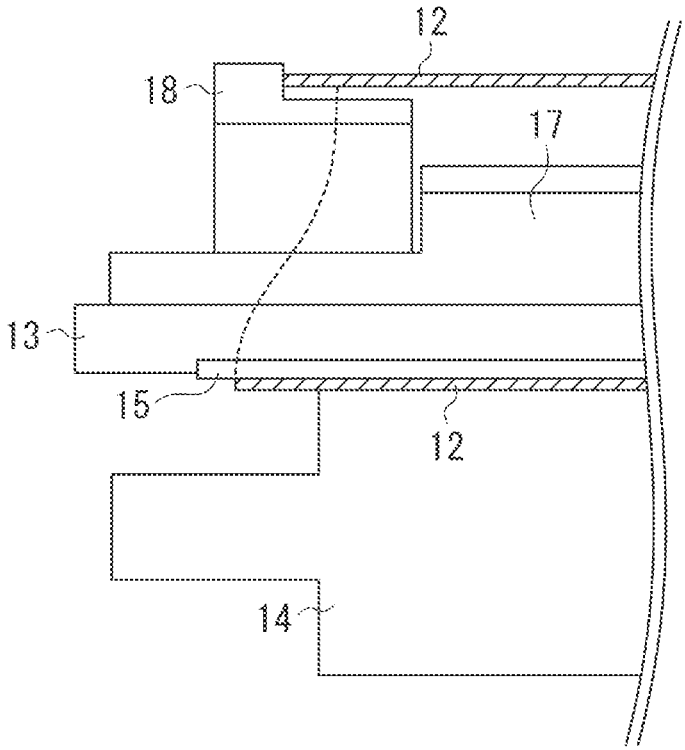

The case where the edge portion of the film 12 is bent toward the inner circumferential surface side of the film 12 as a result of contact with the regulating member 18 will be described with reference to FIGS. 5A, 5B, 5C, 5D, 5E, 5F, and 5G. FIG. 5A is a diagram illustrating a cross-section perpendicular to the generatrix of the film 12 of the conventional fixing device. FIGS. 5B and 5C are sectional views taken along the regulating surface 18*a* (S1-S1), and FIGS. 5D and 5E are sectional views taken along the regulating surface 18*b* (S2-S2). FIG. 5G is a sectional view taken along the nip portion (S3-S3).

Ideally, it is desirable for the end surface of the film 12 and the regulating surface 18*a* to contact each other in parallel to each other as illustrated in FIG. 5B. Actually, however, as illustrated in FIG. 5C, depending upon the positional accuracy or component accuracy of the film 12 and the regulating member 18, the end surface of the film 12 and the regulating surface 18*a* are not parallel to each other, but may receive a reaction force causing the edge portion to bend toward the inner circumferential surface side of the film 12. When the deviation force in coping with a jam exceeds the bending stiffness of the film 12, the edge portion of the film 12 contacting the regulating surface 18*a* is bent toward the inner circumferential surface side of the film 12.

Then, as illustrated in FIG. 5D, the film 12 further moves in the direction indicated by the arrow due to the deviation force, and the edge portion of the film 12 contacts the regulating surface 18*b*. As illustrated in FIG. 5E, when the edge portion of the film 12 is bent toward the inner circumferential surface side of the film 12, the edge portion of the film 12 contacting the regulating surface 18*b* also becomes subject to bending toward the inner circumferential surface side of the film 12. As illustrated in FIG. 5F, the portion of the edge portion of the film 12 bent toward the inner circumferential surface side of the film 12 can be bent by 180 degrees at the maximum.

On the other hand, as illustrated in FIG. 5G, even the edge portion of the film 12 bent by 180 degrees is restored to the former state before entering the inlet of the nip portion. This is because the deformation of the edge portion of the film 12 is an elastic deformation, and, as stated above, there is no regulating surface regulating the edge portion of the film 12 in the vicinity of the nip portion, so that a restoring force is applied to the edge portion of the film 12.

As described above, in the rotational direction, the edge portion of the film 12 is bent toward the inner circumferential surface side of the film 12 at the regulating surfaces 18*a* and 18*b*, and is restored to the former state in the vicinity of the nip portion. As a result of repetition of this bending and restoration, the edge portion becomes subject to fatigue fracture.

Further, as illustrated in FIGS. 6A through 6E, by the same mechanism as with the case that the edge portion of the film 12 is bent toward the inner circumferential surface side of the film 12 as described above, the edge portion of the film 12 can be bent toward the outer circumferential surface side of the film 12. The bending mechanism in this case is the same as with the case that the edge portion of the film 12 is bent toward the inner peripheral surface side of the film 12, so a detailed description thereof will be left out.

Figure 6A:
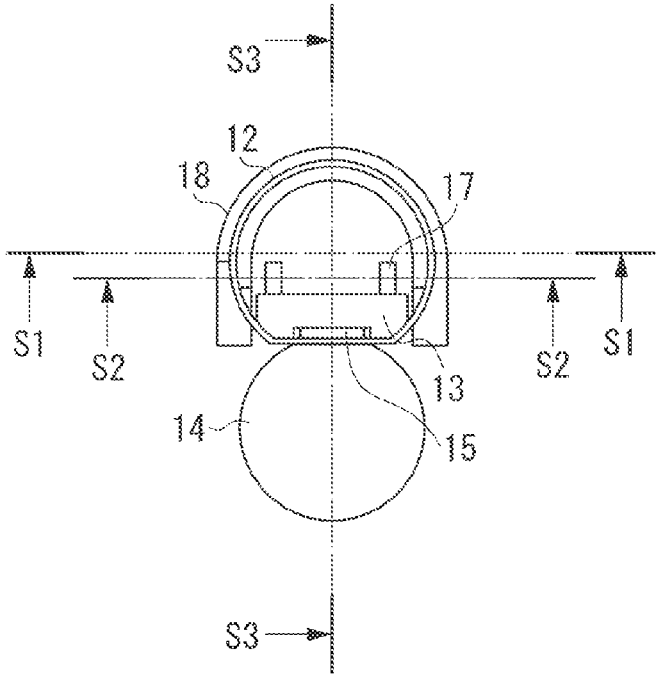
FIG. 6A is a diagram illustrating a cross-section perpendicular to the generatrix of the film of the conventional fixing device.
Figure 6B:
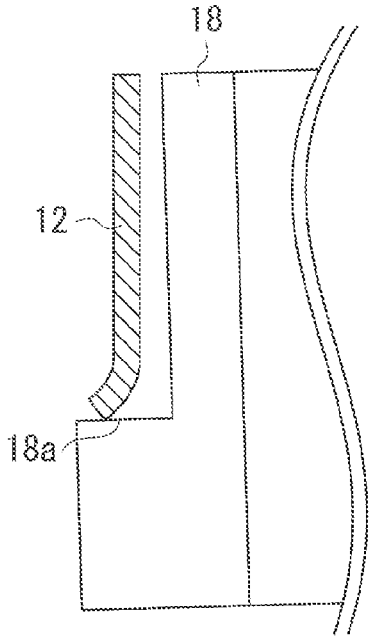
FIGS. 6B, 6C, 6D, and 6E are diagrams illustrating how the film edge portion is bent toward the film outer circumferential surface side as a result of the film edge portion contacting the regulating member in the conventional fixing device.
Figure 6C:
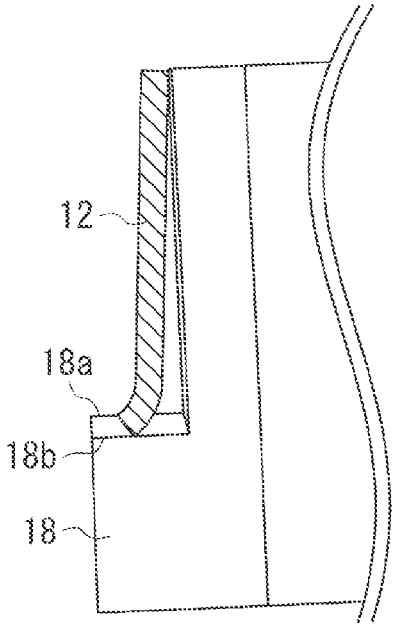
Figure 6D:
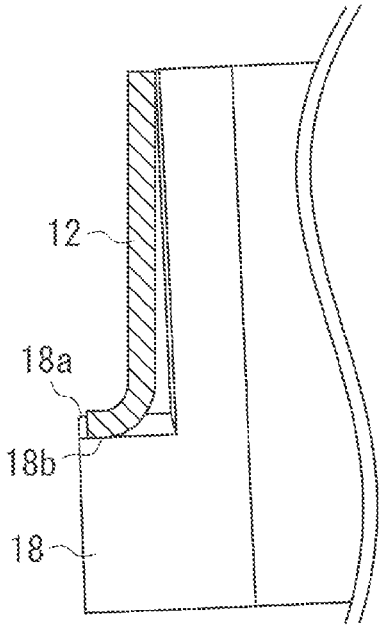
Figure 6E:
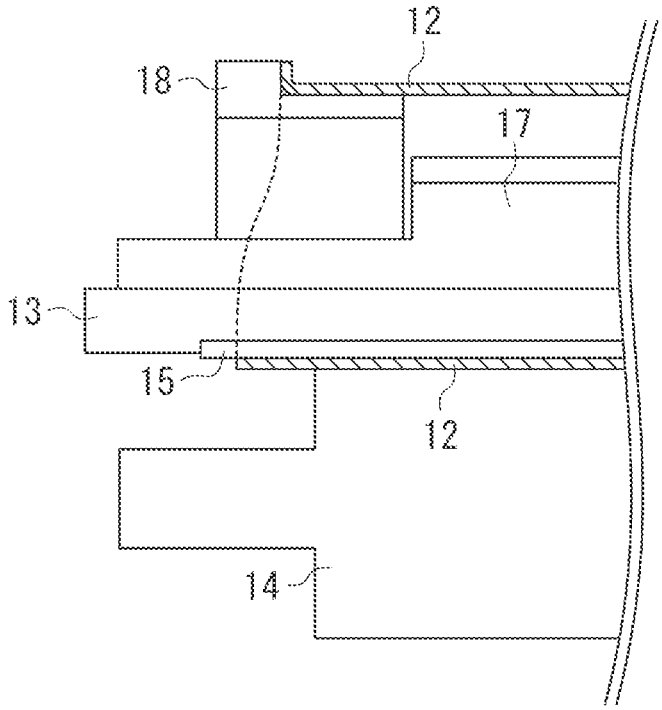

Regarding the maximum angle at which the edge portion of the film 12 is bent by the regulating surface 18*a* or 18*b*, the maximum angle is 180 degrees in the case where the film 12 is bent toward the inner circumferential surface side, whereas the maximum angle is 90 degrees in the case where it is bent toward the outer circumferential surface side as illustrated in FIG. 6D. Accordingly, when the edge portion of the film 12 is bent toward the outer circumferential surface side of the film 12, the film 12 suffers less damage than when being bent toward the inner circumferential surface side, and the film edge portion is less subject to fracture.

Figure 7A:
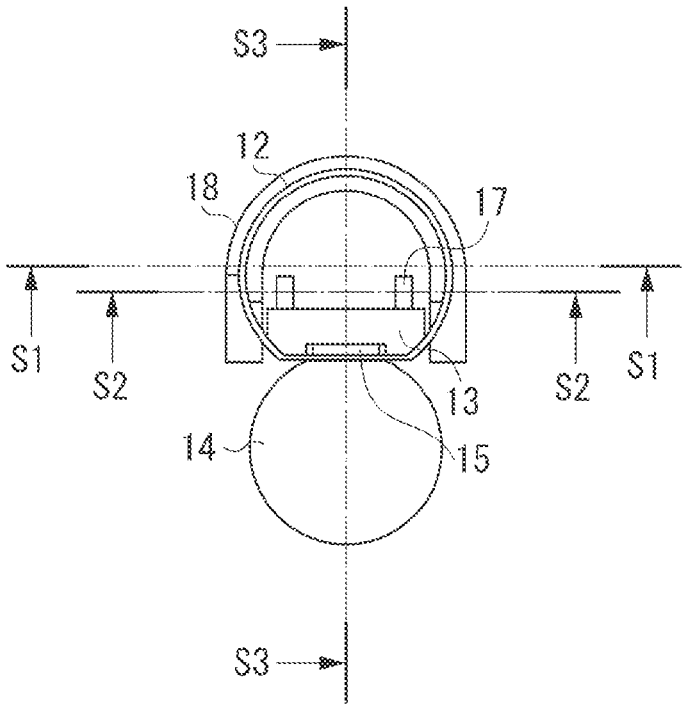
FIG. 7A is a diagram illustrating a cross-section perpendicular to the generatrix of the film of the conventional fixing device.
Figure 7B:
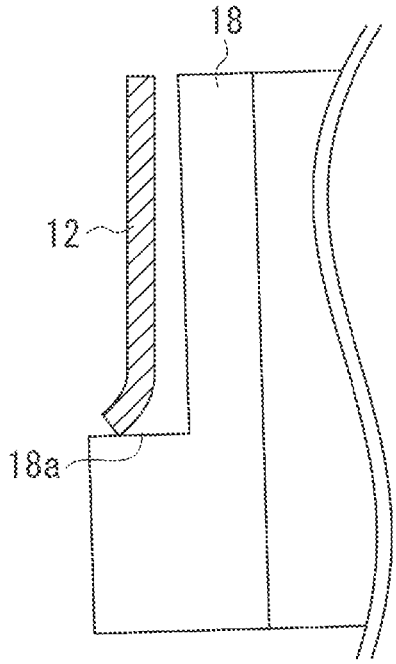
FIGS. 7B, 7C, and 7D are diagrams illustrating how the film edge portion is bent toward the film inner circumferential surface side and the film outer circumferential surface side as a result of the film edge portion contacting the regulating member in the conventional fixing device.
Figure 7C:
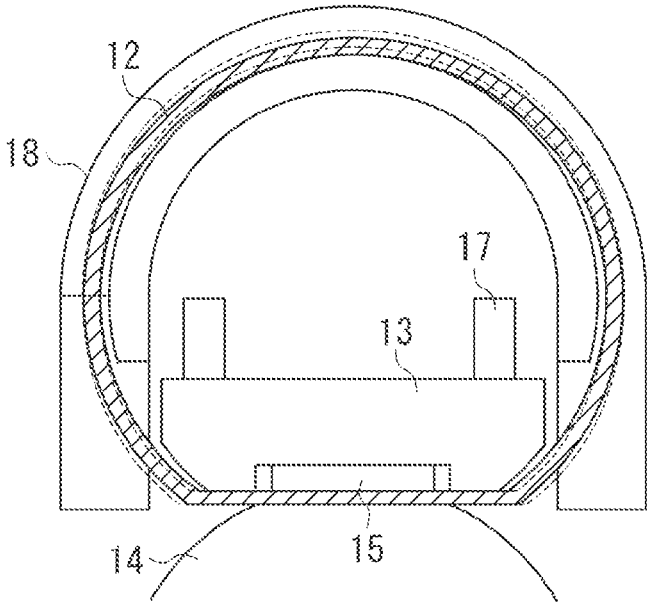
Figure 7D:
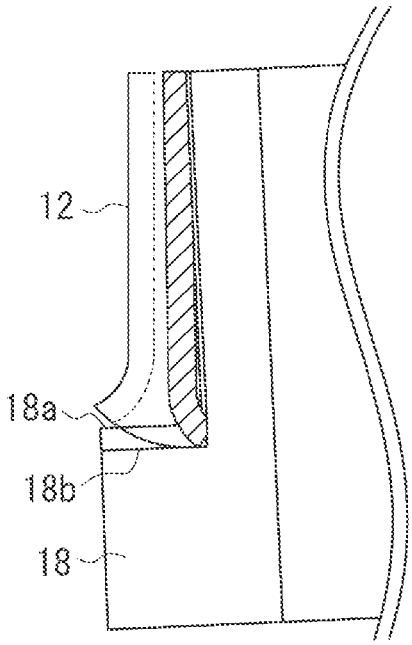

Next, with reference to FIGS. 7A, 7B, 7C, and 7D, there will be provided a description about a case where, as a result of the edge portion of the film 12 contacting the regulating member 18, there simultaneously exist a portion of the edge portion of the film 12 bent toward the inner circumferential surface side and a portion thereof bent toward the outer circumferential surface side of the film 12. FIG. 7A is a diagram illustrating a cross-section of the fixing device taken along a line perpendicular to the generatrix of the film 12. FIG. 7B is a sectional view (S1-S1) illustrating the portion around the regulating surface 18*a*, and FIG. 7D is a sectional view (S2-S2) illustrating the portion around the regulating surface 18*b*. Suppose, at the portion of the edge portion of the film 12 held in contact with the regulating surfaces 18*a* and 18*b*, there is exerted a force causing the edge portion of the film 12 to be bent toward the outer circumferential surface side of the film 12. Even if the edge portion of the film 12 is bent toward the outer circumferential surface side of the film 12, the outer circumference of the film 12 is fixed. Thus, as illustrated in FIG. 7C, the film 12 becomes a shape of an ellipse more elongated in the recording material conveyance direction than a normal state (marked with diagonal lines). Then, immediately after the outlet of the nip portion in the film rotational direction, there can be exerted, due to the tension of the film 12, a force making the edge portion of the film 12 bend toward the inner circumferential surface side of the film 12. Thus, in the circumference of the edge portion of the film 12, there simultaneously exist a portion bent toward the outer circumferential surface side of the film 12 and a portion bent toward the inner circumferential surface side thereof. As a result, a shearing force is exerted at the position where the bending direction of the edge portion of the film 12 is switched, thus making the film edge portion more subject to damage.

In view of the above-mentioned problem in the conventional fixing device with the regulating member 18, a fixing device according to the first exemplary embodiment of the present invention including a regulating member 19 will be described with reference to FIGS. 8A, 8B, 8C, 8D, and 8E, and FIGS. 9A, 9B, 9C, 9D, and 9E. A description of the portions of the same construction as those of the conventional fixing device described above will be left out.

Figure 8A:
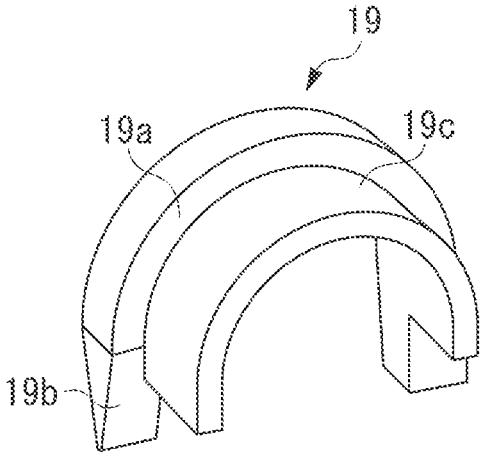
FIG. 8A is a perspective view illustrating a regulating member according to a first exemplary embodiment of the present invention.
Figure 8B:
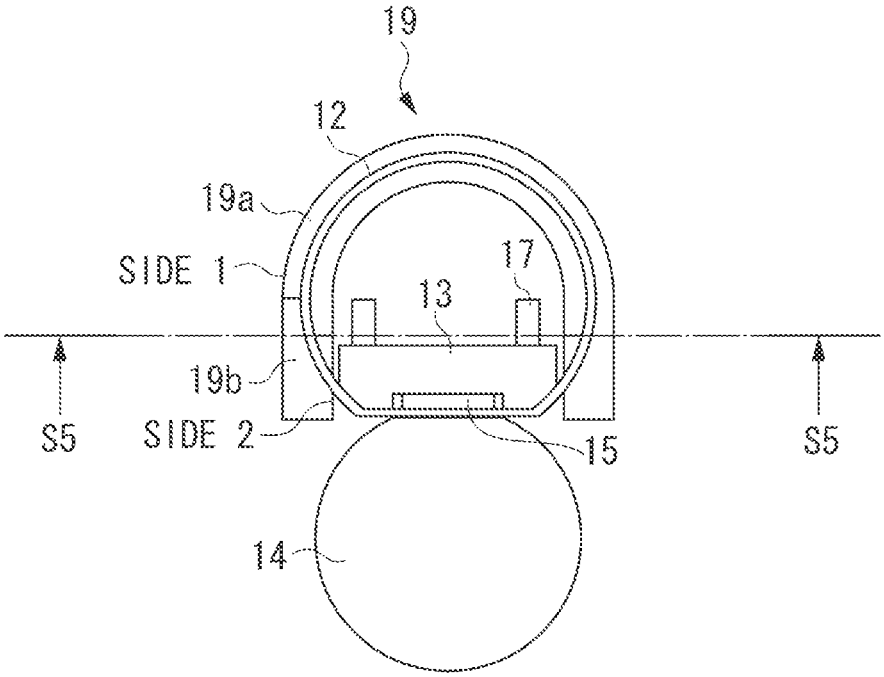
FIG. 8B is a sectional view taken in the generatrix direction of the film illustrating a fixing device according to the first exemplary embodiment.
Figure 8C:
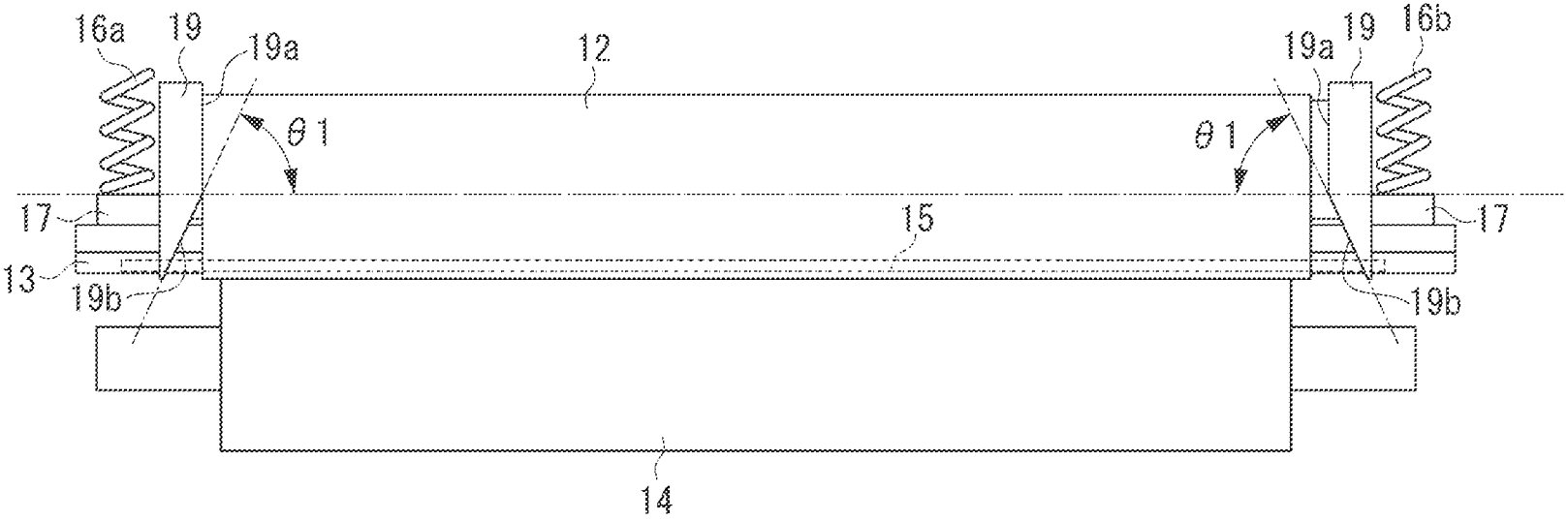
FIG. 8C is a diagram illustrating an angle $\theta_1$ made by a regulating surface of a regulating member according to the first exemplary embodiment and the generatrix of the film.
Figure 8D:
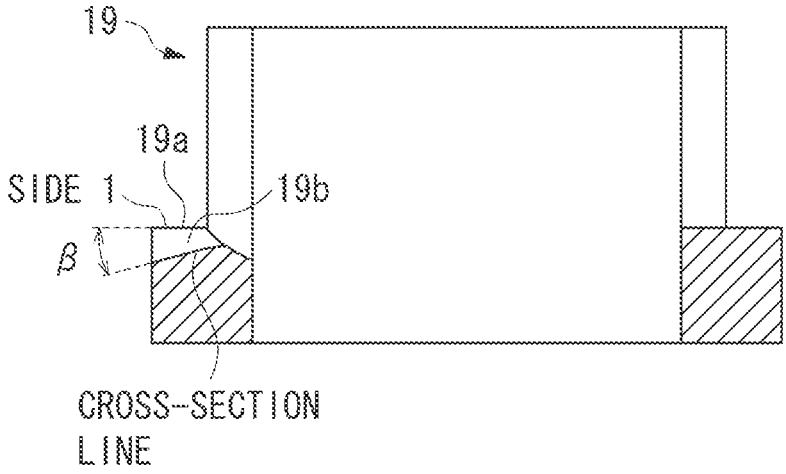
FIG. 8D is a diagram illustrating an angle β made by a side of the regulating member according to the first exemplary embodiment and the cross-section line of an arbitrary cross-section parallel to the generatrix of the film of the regulating member.
Figure 8E:
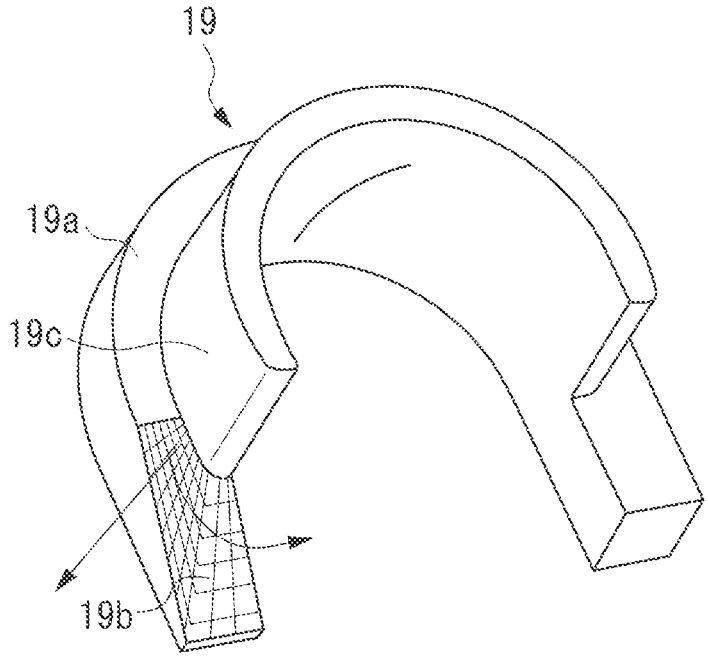
FIG. 8E is a diagram illustrating the regulating surface shaded with lines according to the first exemplary embodiment.

FIG. 8A is a perspective view illustrating the regulating member 19 according to the first exemplary embodiment, and FIG. 8B is a sectional view taken along a line perpendicular to the generatrix of the film 12 illustrating the fixing device according to the first exemplary embodiment. FIG. 8C is a diagram illustrating how the fixing device according to the first exemplary embodiment extends in the direction orthogonal to the recording material conveyance direction. FIG. 8D is a sectional view (S5-S5) illustrating a regulating surface 19*b*. FIG. 8E is a diagram illustrating the regulating surface 19*b* shaded with lines so as to facilitate the understanding of the configuration of the regulating surface 19*b* constituting a feature of the first exemplary embodiment. FIGS. 9A through 9E are diagrams illustrating the behavior of the film 12 in coping with a jam.

A regulating surface 19*a* of the regulating member constituting a first regulating surface is a surface including a region parallel to the end surface of the film 12. The regulating surface 19*b* of the regulating member 19 constituting a second regulating surface is formed so as to gradually decrease a distance from the end surface of the film 12 so as to gradually regulate the end surface of the film 12 in the rotational direction of the film 12 immediately after the outlet for the film 12 at the nip portion. As illustrated in FIG. 8C, the angle $\theta_1$ made by the regulating surface 19*b* and the generatrix of the film 12 at rest is smaller than 90 degrees. So far, the regulating member 19 is of the same construction as the conventional regulating member 18 described above.

Further, the first regulating surface 19*b* of the first exemplary embodiment is inclined such that the distance from an imaginary plane including the end surface of the film 12 is gradually increased in the radial direction of the film 12 (the portion shaded with lines in FIG. 8E). A side 1 on the downstream side in the film rotational direction is on the plane of the regulating surface 19*a*, and the angle β made by a sectional line in an arbitrary cross-section parallel to the generatrix of the film 12 of the regulating surface 19*b* and the side 1 is more than 0 (FIG. 8D). Further, as illustrated in FIG. 8B, a side 2 constituting the introducing portion of the regulating surface 19*b* is arranged at a position as close as possible to the outlet of the nip portion in the film rotational direction so as not to allow the edge portion of the film 12 to be bent inwardly.

In other words, the feature of the regulating surface 19*b* of the first exemplary embodiment is that the regulating surface 19*b* includes, in the vicinity of the nip portion, a regulating surface inclined such that the distance from the imaginary plane including the end surface of the film 12 is gradually decreased as the regulating surface extends away from the nip portion in the circumferential direction of the film 12, and such that the distance therefrom is gradually increased as the regulating surface extends in the radial direction of the film 12. The regulating surface 19*b* is a surface which is parallel to the end surface of the film 12 and whose upstream side and downstream side in the recording material conveyance direction are symmetrical with respect to the center of the nip portion in the recording material conveyance direction. It is not necessary for the entire area of the regulating surface 19*a* to be parallel to the end surface of the film 12. It is only necessary for the regulating surface 19*a* to be a surface which includes an area parallel to the end surface of the film 12 and whose upstream side and downstream side areas in the recording material conveyance direction are symmetrical.

The regulating surface 19*b* is configured to make the edge portion of the film 12 constantly bend to the outer circumferential surface side of the film 12, by the reaction force received from the regulating surface 19*b*. The mechanism which causes the edge portion of the film 12 to constantly bend to the outer circumferential surfaces side of the film 12 by virtue of the regulating surface 19*b*, and the reason why the film edge portion damage is not easily caused, will be described below.

Figure 9A:
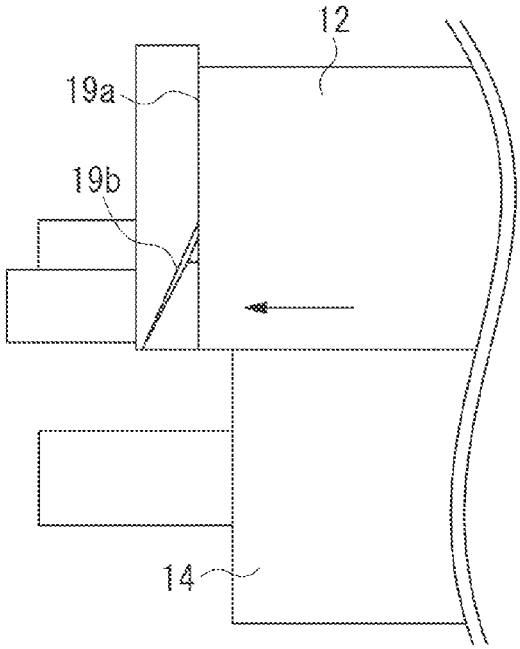
FIGS. 9A, 9B, 9C, 9D, and 9E are diagrams illustrating how the film edge portion and the regulating member contact each other in the fixing device according to the first exemplary embodiment.
Figure 9B:
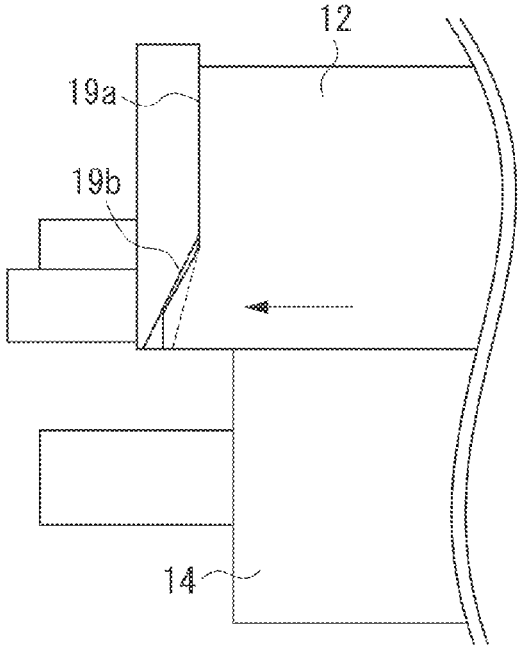
Figure 9C:
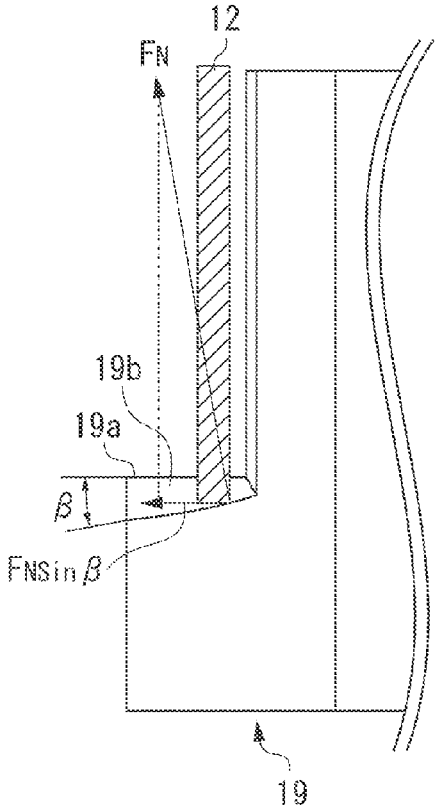
Figure 9D:
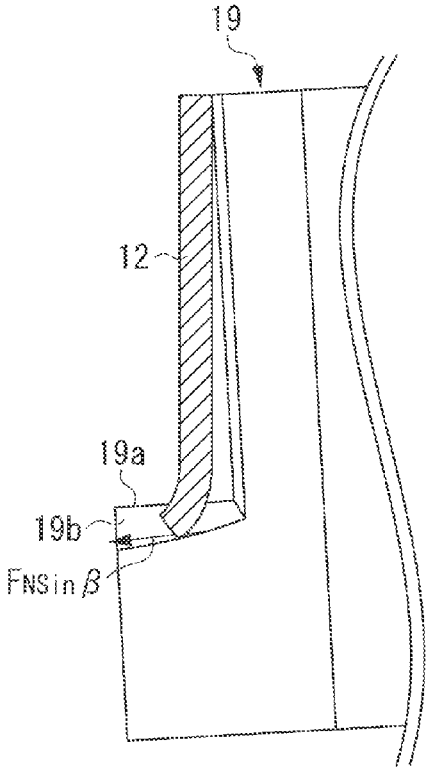

As illustrated in FIG. 9B or 9C, immediately after deviation force is generated in the film 12 as a result of coping with a jam, the edge portion of the film 12 contacts the regulating surface 19*a*, and the film 12 can be bent toward the inner circumferential surface side or the outer circumferential surface side. Then, as in the case of the conventional fixing device described with reference to FIG. 5D, the end surface of the film 12 contacts the regulating surface 19*b*. Since the regulating surface 19*b* is at an angle β with respect to the imaginary plane including the end surface of the film 12 (or the regulating surface 19*a*), the film 12 receives a force causing the edge portion thereof to be outwardly bent (the component FNsinβ of the vertical reaction force FN of the regulating surface 19*b*) as illustrated in FIG. 9B. As illustrated in FIG. 9*c*, in the case where the edge portion of the film 12 is bent toward the outer circumferential surface side of the film 12 on the regulating surface 19*a*, the edge portion of the film 12 is also likely to be bent toward the outer circumferential surface side on the regulating surface 19*b*. Thus, the entire circumference of the edge portion of the film 12 is bent toward the outer circumferential surface side of the film 12.

Figure 9E:
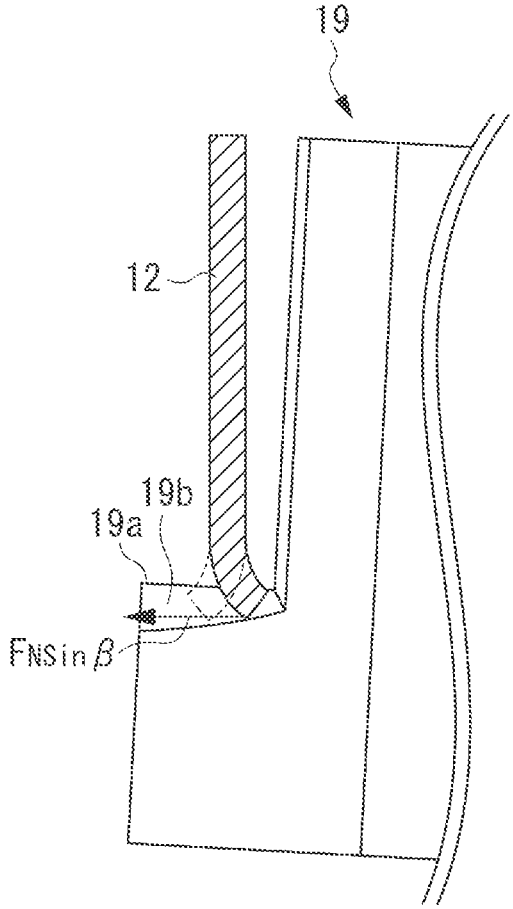

Next, the case where, as illustrated in FIG. 9B, the edge portion of the film 12 is bent toward the inner circumferential surface side of the film due to the regulating surface 19*a* will be described. When the edge portion of the film 12 contacts the regulating surface 19*b*, the force FNsinβ is applied to the edge portion of the film 12, and the edge portion is bent toward the outer circumferential surface side of the film 12 as illustrated in FIG. 9E. Further, while coping with a jam, so long as the direction in which the recording material is pulled out is not changed, a deviation force continues to be applied to the film 12. Accordingly, although the edge portion of the film 12 which has been bent toward the outer circumferential surface side of the film 12 by the nip portion is restored to the former state when entering the nip portion as described above, the edge portion of the film 12 contacts the regulating surface 19*b* to be outwardly bent again immediately after leaving the nip portion.

Next, a case where, in the circumference of the edge portion of the film 12, there simultaneously exist a portion bent toward the outer circumferential surface side of the film 12 and a portion bent toward the inner circumferential surface side thereof, will be described. Even in such a case, since the regulating surface 19*b* is inclined with respect to the regulating surface 19*a* at the angle β, there is exerted, as illustrated in FIG. 9E, a force (FNsinβ) causing the edge portion of the film 12 to bend toward the outer circumferential surface side of the film 12, and the edge portion of the film 12 is bent toward the outer circumferential surface side (as marked with diagonal lines). Thus, in the entire circumference of the edge portion of the film 12, the edge portion of the film 12 can be bent in the direction toward the outer circumferential surface side. As a result, the angle at which the film edge portion can be bent is 90 degrees at the maximum. Thus, as compared with the conventional fixing device, in which bending by a maximum angle of 180 degrees can be repeated, the damage of the film edge portion can be suppressed.

Thus, according to the first exemplary embodiment, the film edge portion damage can be suppressed even when a deviation force larger than that at the time of fixing is applied to the film 12 while coping with a jam.

Figure 11:
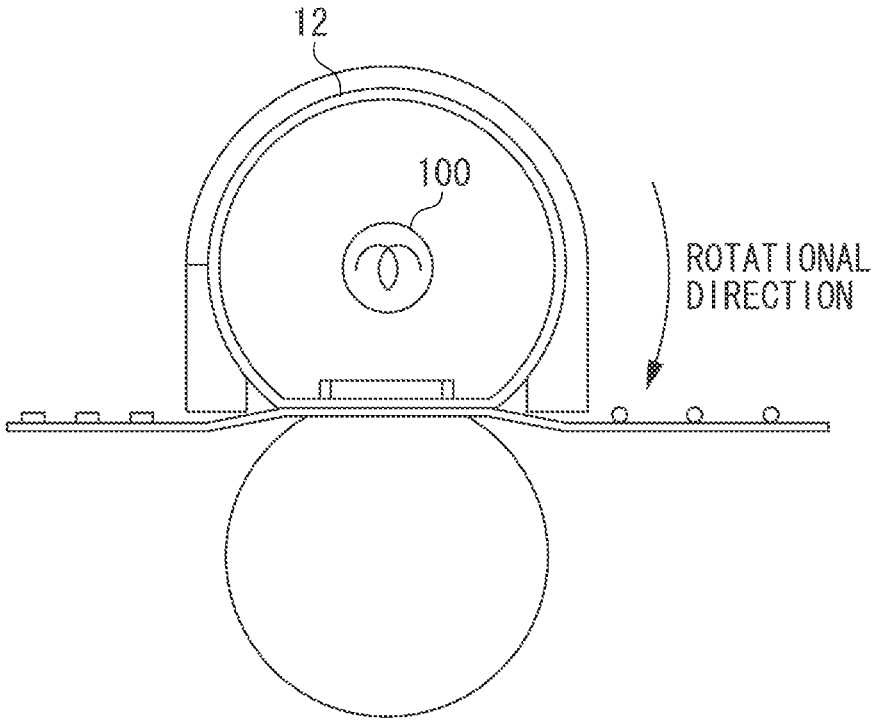
FIG. 11 is a sectional view illustrating a fixing device according to a modification of the first exemplary embodiment.

In the first exemplary embodiment, a heater contacting the inner circumferential surface of the film to heat the film is employed as a heat source. However, as in the case of the fixing device illustrated in FIG. 11, the first exemplary embodiment is also applicable to a construction which includes a halogen heater 100 enclosed in the film 12 as the heat source to heat the inner circumferential surface of the film 12 by the radiation heat of the halogen heater 100.

A second exemplary embodiment will be described with reference to FIG. 10. The second exemplary embodiment is of the same construction as the first exemplary embodiment except for a regulating member 20, so a redundant description thereof will be left out.

Figure 10:
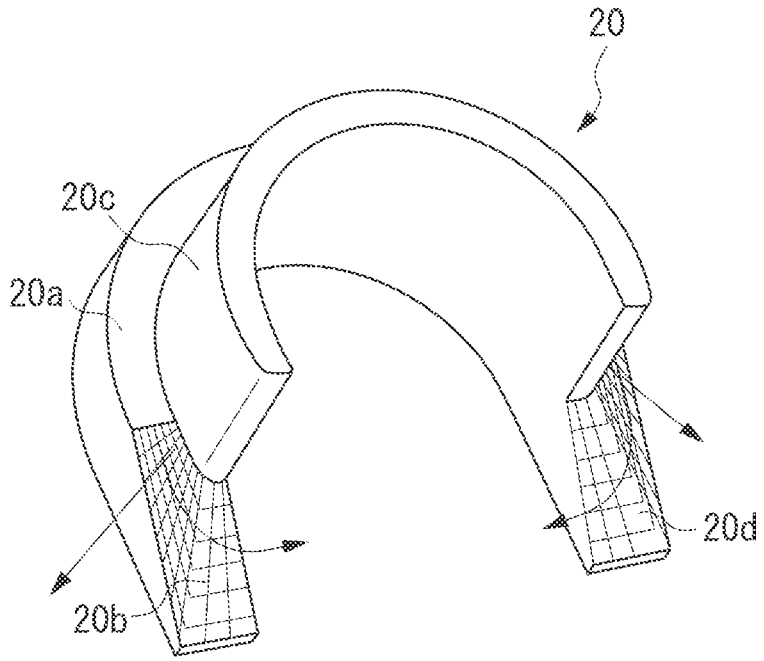
FIG. 10 is a perspective view illustrating a regulating member according to a second exemplary embodiment.

FIG. 10 is a diagram illustrating a regulating surface 20*b* and a regulating surface 20*d*, shaded with lines, of the regulating member 20 according to the second exemplary embodiment so as to depict configuration thereof in a manner easy to understand.

Of the regulating member 20, the regulating surface 20*a* as the first regulating surface and the regulating surface 20*b* as the second regulating surface are the same as the regulating surfaces 19*a* and 19*b* of the first exemplary embodiment, so a description thereof will be left out. The second exemplary embodiment differs from the first exemplary embodiment in that the regulating member 20 is also provided with the regulating surface 20*d*, as a third regulating surface on the inlet side of the nip portion (the upstream side thereof in the recording material conveyance direction) in the film rotational direction at the time of fixing. The regulating surface 20*d* is a regulating surface which is inclined such that a distance from an imaginary plane including the end surface of the film 12 is gradually decreased as the regulating surface 20*d* extends away from the nip portion in the film circumferential direction and that the distance therefrom is gradually decreased as the regulating surface 20*d* extends in the radial direction of the film 12.

Here, the role of the regulating surface 20*d* will be described. While coping with a jam, the user does not always pulls out the recording material from the downstream side (outlet side) in the recording material conveyance direction of the nip portion. In some cases, the user may pull out the recording material from the upstream side of the nip portion in the recording material conveyance direction. When the recording material is pulled out from the upstream side of the nip portion in the recording material conveyance direction, the film rotational direction is reverse to the film rotational direction at the time of fixing. In other words, the inlet and the outlet of the nip portion are reversed. Thus, the regulating member 20 according to the second exemplary embodiment includes the regulating surface 20*b* in the vicinity of the outlet of the nip portion and the regulating surface 20*d* in the vicinity of the inlet of the nip portion in the rotational direction of the film at the time of fixing.

Thus, in the second exemplary embodiment, the regulating surfaces 20*b* and 20*d* are respectively provided on the downstream side and the upstream side of the nip portion in the recording material conveyance direction, whereby the damage of the film edge portion can be suppressed independently of the direction in which the recording material is pulled out from the nip portion.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-177143 filed Aug. 12, 2011, which is hereby incorporated by reference herein in its entirety.

What is claimed is:

1. A fixing device configured to heat a recording material bearing a toner image at a nip portion while conveying the recording material thereby to fix the toner image onto the recording material, the fixing device comprising:

a tubular film;

a nip portion forming member contacting an inner surface of the film;

a pressure member forming the nip portion together with the nip portion forming member via the film; and a regulating member configured to regulate a movement of the film by contacting an end surface of the film in a generatrix direction of the film when the film moves in the generatrix direction, wherein the regulating member includes an inclined regulating surface opposed to an area which is one including the nip portion of two areas of the end surface halved by an imaginary plane parallel to the nip portion, the inclined regulating surface inclined such that a distance from an imaginary plane including the end surface is gradually decreased as the regulating surface extends away from the nip portion in a circumferential direction of the film and that the distance therefrom is gradually increased as the regulating surface extends in a radial direction of the film.

2. The fixing device according to claim 1, wherein the regulating member further includes a second regulating surface continuous with the inclined regulating surface and including an area parallel to the end surface, and wherein the area includes a surface whose upstream side and downstream side in a recording material conveyance direction are symmetrical with respect to the center of the nip portion in the recording material conveyance direction.

3. The fixing device according to claim 1, wherein the nip portion forming member includes a heater.

4. The fixing device according to claim 1, further comprising a halogen heater enclosed in the film, wherein an inner surface of the film is heated by radiation heat of the halogen heater.

5. A fixing device configured to heat a recording material bearing a toner image at a nip portion while conveying the recording material thereby to fix the toner image onto the recording material, the fixing device comprising:

a tubular film;

a nip portion forming member contacting an inner surface of the film;

a pressure member forming the nip portion together with the nip portion forming member via the film; and a regulating member configured to regulate a movement of the film by contacting an end surface of the film in a generatrix direction of the film when the film moves in the generatrix direction, wherein the regulating member includes a regulation surface opposed to the end surface and an opposed portion opposed to the inner surface of the film from an upstream side to a downstream side of the nip portion except for a vicinity of the nip portion in a rotational direction of the film, and wherein the regulation surface includes an inclined area in the vicinity of the nip portion where the opposed portion is not disposed, the inclined area inclined such that a distance from an imaginary plane including the end surface is gradually decreased as the regulating surface extends away from the nip portion in a circumferential direction of the film and that the distance therefrom is gradually increased as the regulating surface extends in a radial direction of the film.

6. The fixing device according to claim 5, wherein the regulating surface further includes a second area continuous with the inclined area, a surface on the second area paralleled to the end surface.

7. The fixing device according to claim 5, wherein the nip portion forming member includes a heater.

8. The fixing device according to claim 5, further comprising a halogen heater enclosed in the film, wherein an inner surface of the film is heated by radiation heat of the halogen heater.

9. A fixing device configured to heat a recording material bearing a toner image at a nip portion while conveying the recording material thereby to fix the toner image onto the recording material, the fixing device comprising:

a tubular film;

a nip portion forming member contacting an inner surface of the film;

a pressure member forming the nip portion together with the nip portion forming member via the film; and a regulating member configured to regulate a movement of the film by contacting an end surface of the film in a generatrix direction of the film when the film moves in the generatrix direction, wherein the regulating member includes a regulation surface opposed to the end surface and an opposed portion in an arch shape disposed in such a way that the nip portion is arranged between two end portions of the opposed portion, and wherein the regulation surface includes an inclined area in a region where the pressure member is disposed, with reference to a line passing through the two end portions, the inclined area inclined such that a distance from an imaginary plane including the end surface is gradually decreased as the regulating surface extends away from the nip portion in a circumferential direction of the film and that the distance therefrom is gradually increased as the regulating surface extends in a radial direction of the film.

10. The fixing device according to claim 9, wherein the regulating surface further includes a second area continuous with the inclined area, a surface on the second area paralleled to the end surface.

11. The fixing device according to claim 9, wherein the nip portion forming member includes a heater.

12. The fixing device according to claim 9, further comprising a halogen heater enclosed in the film, wherein an inner surface of the film is heated by radiation heat of the halogen heater.

* * * * *